United States Patent [19]

Weber et al.

[11] 4,422,857

[45] Dec. 27, 1983

[54] COKE GASIFICATION METHOD

[75] Inventors: Heinrich Weber, Recklinghausen; Horst Dungs, Herne; Kurt Tippmer, Recklinghausen, all of Fed. Rep. of Germany

[73] Assignee: Firma Carl Still GmbH & KG, Fed. Rep. of Germany

[21] Appl. No.: 398,593

[22] Filed: Jul. 15, 1982

Related U.S. Application Data

[62] Division of Ser. No. 289,158, Aug. 3, 1981.

[30] Foreign Application Priority Data

Aug. 27, 1980 [DE] Fed. Rep. of Germany ..... 3032212

[51] Int. Cl.[3] ..... C10J 3/06; C10J 3/16

[52] U.S. Cl. ..... 48/197 R; 48/202; 48/203; 48/206; 252/373

[58] Field of Search ..... 48/197 R, 203, 206, 48/202, 210; 252/373

[56] References Cited

U.S. PATENT DOCUMENTS

| | | | |
|---|---|---|---|
| 666,257 | 1/1901 | Besenfelder | 48/202 |
| 4,017,272 | 4/1977 | Anwer et al. | 48/197 R |
| 4,233,036 | 11/1980 | Koch et al. | 48/210 |

*Primary Examiner*—Peter F. Kratz

*Attorney, Agent, or Firm*—McGlew and Tuttle

[57] ABSTRACT

A method for the gasification of coke is disclosed in which coke produced in a coking chamber and having a temperature of 900° C. to 1100° C. is forced into a coke bucket, after coking in the coking chamber, and fed by means of hot coke conveyors without substantial temperature changes to a gasifier. The coke is gasified in the gasifier while adding at least one of oxygen and air, and steam and carbon dioxide.

5 Claims, 1 Drawing Figure

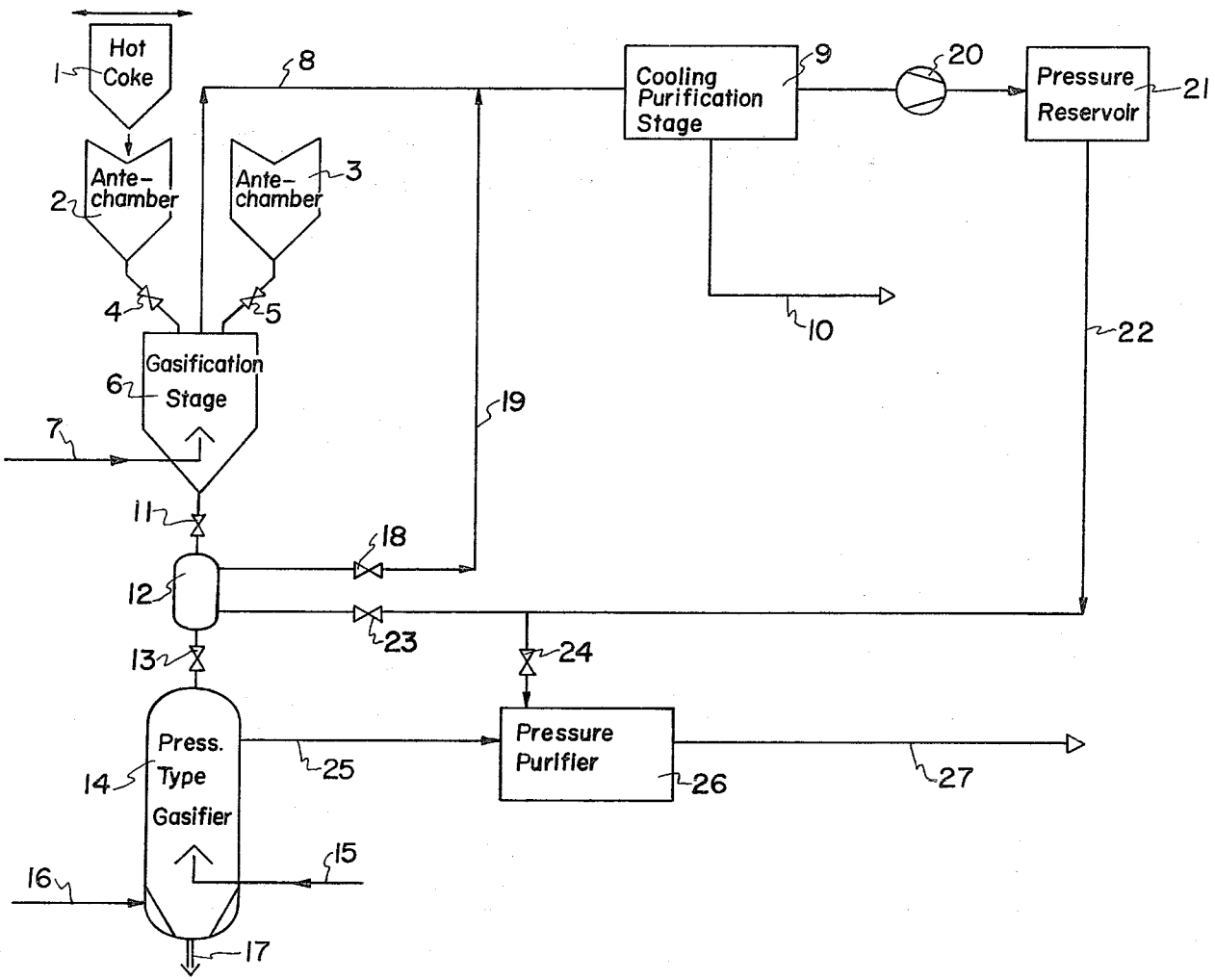
Hot Coke
Ante-chamber
Ante-chamber
Gasification Stage
Cooling Purification Stage
Pressure Reservoir
Pressure Purifier
Press. Type Gasifier
1
2
3
4
5
6
7
8
9
10
11
12
13
14
15
16
17
18
19
20
21
22
23
24
25
26
27

COKE GASIFICATION METHOD

This is a division of application Ser. No. 289,158 filed Aug. 3, 1981.

FIELD AND BACKGROUND OF THE INVENTION

The invention concerns a method fo the gasification of coke in connection with chamber coking.

In coke gasification, depending on different applications of the gas in the various industrial sectors, either a lean gas or a generator gas or a water gas or a synthetic gas can be produced. The lean or generator gas is produced with air as a gasifying agent, and contains carbon monoxide, hydrogen, small amounts of carbon dioxide, and about 45 to 65% nitrogen, while water gas is produced through the gasification of coal with steam and contains about 40% carbon monoxide and 50% hydrogen.

Water gas is usually produced in an alternating operation, by alternately "hot blowing" air in a fuel layer and alternately treating so called gas or "cold blowing" with steam. These discontinuous gasification methods involve large temperature fluctuations during cold and hot blowing which result in change-over problems. Continuous methods are known wherein steam and air or oxygen are introduced simultaneously into the coke charge, and a mixed gas is produced (see Grosskinsky, Handbuch des Kokereiwesens (Handbook of Coking) vol. 1, p. 357ff.).

In all methods for the gasification of high-temperature coke, the coke to be gasified is commonly introduced into the gasifier, in a cold (unheated) state. Moreover, such methods require significant amounts of thermal energy to initially heat the gasifier to operating temperature.

Subjecting the coal to low-temperature carbonization prior to the gasification proper is known in coke gasification methods wherein a carbonization shaft is attached on the gasification reactor proper, and the heat of carbonization is introduced through a partial current of the hot manufactureed gas (see Ullmann, vol. 10, 1958, p. 388 and p. 427). However, the output of this generator (with the carbonization attachment) is substantially lower due to the lower stability of the carbonized fuel, as compared to high temperature coke. In addition, the temperature of the low-temperature coke is so low that generation of water gas is not possible without previous heating.

SUMMARY OF THE INVENTION

An object of the invention is to provide a new and improved method for the gasification of coke that has a higher thermal efficiency than the known methods in which a crude gas with high portions of hydrogen and carbon monoxide are produced.

The solution of the problem according to the invention, resides in first carbonizing the coke, forcing the coke at a temperature ranging from 900° C. to 1100° C. into a coke bucket, after coking in the coke chamber, and transfering the coke, by means of hot coke-conveyors, without substantial temperature changes, to a gasifier wherein it is gasified while adding oxygen or air, or both, and steam, and carbon dioxide. In the method according to the invention, there is no cooling or quenching of the hot coke, forced out from the horizontal chamber-coke oven, to the ambient temperature, so that the heat energy given off heretofore to the surrounding, at least in wet quenching, can also be utilized in the gasification. The inventive method is particularly applicable where a coke is produced in the horizontal chamber-coking batteries from slow-burning coal, e.g. high volatile coal, which does not quite meet the requirements of the blast furnace, as far as strength is concerned, but which already has a certain strength.

The method of the invention is additionally characterized in that the coke is fed, after coking in the coking chamber, with a temperature ranging from 900° C. to 1100° C. to a first cooling and gasification stage, where it is partly gasifiefd by the addition of steam and cooled to 500° C. to 800° C. and subsequently introduced over a pressure-dosing system into a pressure-type gasifier as a second stage, and gasified there by solid bed gasification by the addition of oxygen or air, or both, and steam or carbon dioxide, or both. It was found expedient for the new method to charge the steam with a temperature of at least 400° C. in the coking and partial gasification stage.

In this way, the production of water gas is substantially enhanced, so that up to 4% of the employed coke is already gasified in this first partial gasification stage. In addition to the cooling of the coke by the water gas reaction, the coke can be cooled additionally to a temperature of 500° C. by the added excess water gas. Cooling to this temperature is advantageous in that the introduction of the coke into the subsequent pressure gasification stage is much less problematic than when the temperature is at 1000° C.

According to the invention, the gas can be withdrawn from the first cooling and gasification stage with a temperature of 600° to 850° C. and after cooling and preliminary purification, compressed further for use. The gas consists exclusively of hydrogen and carbon monoxide and can be used without compression, for example, as an undergrate firing gas or be fed to outer suitable devices.

Furthermore, the invention provides that the cooling and partial gasification are effected under a pressure of 100 to 1000 mm water column. In these pressure ranges, sealing at the inlet and outlet points can be relatively simple and inexpensive.

The pressure gasification proper is effected according to the invention under a pressure of 5 to 60 bar.

Uniform charging of the pressure-type gasifier with hot coke can preferably be effected over a pressure dosing system with at least four parallel connected lock chambers, where the following operations take place simultaneously:a first lock is filled with hot coke; a second lock, which has already been filled with hot coke, is compressed, that is, brought up to the gasifier pressure; a third lock gives off the hot coke to the gasifier; and a fourth lock is expanded.

The lock chambers are made only large enough so that when their content if filled into the pressure gasification chamber, there can be no major pressure and temperature fluctuations there. The arrangement of four pressure lock chambers permits practically continuous charging.

Naturally, it may be advantageous, in certain instances, to employ less than four lock chambers if a discontinuous operation can be provided.

A particularly neat and expedient embodiment of the method, according to the invention, can be achieved by taking the compression gas for the locks from the prepurified gas from the first cooking and gasification stage after the compression. The expansion gas from the locks can also be fed to the gas from the first cooling and gasification stage, or it can be returned directly into the cooling and partial gasification stage.

In this way pressure equalization can be achieved in the lock chambers by simply reversing the respective valves.

Excess gas from the first cooling and gasification stage can be preferably fed, after compression, to the pressure purification station for the gas from the pressure-type gasifier.

Depending on the use of the gas, the invention provides that the hydrogen to carbon monoxide ratio of the generated gas can be varied by the addition of the coke oven gas. The hydrogen to carbon monoxide ratio of coke oven gas ranges approximately on order of magnitude (10 to 1) higher than the hydrogen to carbon monoxide ratio of the crude gas produced in the gasifier. It has also been found advantageous to use the steam generated in the quenching zone of the pressure-type gasifier to cool the slag during the gasification. It is thus possible to reduce the amount of the gasifying agent added from the outside to the gasification. The gasification of the hot coke obtained in chamber coking with a temperature of 900° C. to 1100° C. has the following advantages in the solid bed reactor over other gasification methods. First, the method has high thermal efficiency, since the charging product is already made available and used with the gasification temperature. Secondly, the crude gas produced is free of heavy hydrocarbons (tar, oil, naphthalene and carbon black), even at low gasification temperatutes and pressures. Third, lumpy coke with a lower strength and higher sulfur content can be processed, which means that slow-burning and inexpensive coking coal can also be used in the coking plant.

Accordingly, it is an object of the invention to provide a method for the gasification of coke having a temperature of 900° C. to 1100° C. after coking in a coking chamber comprising the steps of forcing the coke with a temperature of 900° C. to 1100° C. into a coke bucket, after coking in the coking chamber, and feeding the coke by means of hot coke conveyors without substantial temperature changes to a gasifier, and gasifying the coke in the gasifier while adding at least one of oxygen and air, and steam and carbon dioxide.

It is a further object of the invention to provide a coke gasification method which is simple and economical.

The various features of novelty which characterize the invention are pointed out with particularity in the claims annexed to and forming a part of this disclosure. For a better understanding of the invention, its operating advantages and specific objects attained by its uses, reference is made to the accompanying drawing and descriptive matter in which a preferred embodiment of the invention is illustrated.

BRIEF DESCRIPTION OF THE DRAWING

The sole drawing is a schematic illustration of the method according to the invention.

DETAILED DESCRIPTION

Referring to the drawing in particular, there is shown a hot coke bucket 1 whose contents can be charged directly into the gasifier or, as illustrated in the drawing, into one of two or more hot coke antechambers 2,3. In order to deliver the hot coke to these antechambers 2,3, hot coke bucket 1 can be moved back and forth on a platform and be lowered onto the corresponding antechamber 2 or 3. After the filling, the antechamber 2 or 3 is closed at the top and a bottom lock, 4 or 5 respectively, is opened. After the bottom lock 4 or 5 has been opened, the hot coke slides into a first cooling and partial gasification tank 6, which is sufficiently sized so that it can hold one to three fillings of the antechambers. The hot coke is substantially cooled in the cooling and partial gasification tank 6 to 500° C. to 800° C. by water gas reaction while adding hot steam over a connection 7. The gas so formed is withdrawn at a temperature of 600° to 850° C. through a pipe 8, fed to a cooling and preliminary purifying station 9 and removed through a pipe 10, unless it is needed in the rest of the system. From the cooling and partial gasification tank 6, which has to be kept only under a slight overpressure of a few hundred mm water column, the precooled coke is filled over a pressure dosing system 11, 12, 13 into a pressure-type gasifier 14 proper. Only one of the four top and bottom locks 11, 13 and lock chamber 12 proper, in the pressure dosing system is shown in the drawing. Likewise, each of the four lock chamber 12 has a connection with a valve 18 leading to pipes 19 and 8 for removal of the expansion gas, and a connection with a valve 23 to a pipe 22 or a pressure reservoir 21, over which the compression gas is supplied. The gas obtained in the first cooling and partial gasification stage 6 is used as a compression gas, after passing through the cooling and purification stage 9, and a compressor or compression stage 20. The excess gas from the first stage 6 can also be fed from the pressure reservoir 21 over pipe 22 and a valve 24 to a pressure purifier 26 for the gas withdrawn over a pipe 25 from the pressure type gasifier 14, and then be removed from the system overpipe 27 together with the latter. The necessary gasifying agent oxygen and/or air and/or steam and/or carbon dioxide is added in the lower region of the pressure-type gasifier 14, over connection 15. Before the residues of the gasification are withdrawn over a lock system in a sump 17, so-called quenching water is added over connection 16 for cooling the hot slag.

Thus, in accordance with the invention, there is provided a method for the gasification of coke in connection with chamber coking, characterized in that the coke is forced with a temperature of 900° C. to 1100° C. into a coke bucket, after coking in the coking chamber, and fed by means of hot coke conveyors without substantial temperature changes to a gasifier and gasified there by adding oxygen and/or air, steam, and carbon dioxide.

The inventive method is further characterized in that the coke is fed without substantial temperature changes with a temperature of 900° C. to 1100° C. to a first cooling and gasification stage, after coking in the coke chamber, is partially gasified by the addition of steam and cooled to 500° C. to 800° C., and substantially fed over a pressure-dosing system to a pressure-type gasifier as the second stage, and gasified there by solid bed gasification with the addition of oxygen and/or air, and steam and/or carbon dioxide. In accordance with a preferred embodiment of the inventive technique, the gas is withdrawn from the first cooling and gasification stage with a temperature of 600° C. to 850° C. and compressed for further use after cooling and preliminary purification.

The first cooling and partial gasification is effected under a pressure 100 to 1000 mm water column. The pressure gasification is effected under a pressure of 5 to 100 bar, preferably 5 to 60 bar.

In accordance with a preferred embodiment of the invention, there is provided a method for the uniform charging of the pressure-type gasifier with hot coke, characterized in that the charging is effected over a pressure-dosing system with at least four parallel connected lock chambers, in which the following operations take place simultaneously:

a first lock is filled with hot coke, a second lock, which has already been filled with hot coke, is compressed, that is, brought up to the gasifier pressure, a third lock gives off the hot coke to the gasifier, a fourth lock is expanded.

This method is further characterized by taking the compression gas for the locks from the pre-purified gas from the first cooling and gasification stage after the compression. The expansion gas from the locks is preferably fed to the gas from the first cooling The excess gas from the first cooling and gasification stage may be fed after compression to the pressure purification station for the gas from the pressure-type gasifier. The method may still be further characterized by change of the hydrogen to carbon monoxide ratio of the generated gas by the addition of coking gas from the coking chambers.

The steam generated in the quenching zone of the pressure-type gasifier during the cooling of the slag, in one development of the invention, is used in the gasification.

While a specific embodiment of the invention has been shown and described in detail to illustrate the application of the principles of the invention, it will be understood that the invention may be embodied otherwise without departing from such principles.

What is claimed is:

1. A method of uniformly charging a pressure-type gasifier with hot coke, comprising the steps of charging over a pressure-dosing system with at least four parallel-connected lock chambers, in which the following steps in the four lock chambers take place simultaneously:

filling a first lock with hot coke;

comprising a second lock, which has already been filled with hot coke, with a compression gas up to the gasifier pressure;

transfering hot coke from a third lock to the pressure-type gasifier; and expanding a fourth lock, wherein the hot coke is formed in a coking chamber with a temperature of 900° C. to 1,100° C., the hot coke is fed by means of a hot coke conveyor without substantial temperature changes with the coke at a temperature of 900° C. to 1,100° C. to a first gasification chamber, the coke is partially gasified and cooled to 500° C. to 800° C. in the first gasification chamber by the addition of steam, then the partially gasified coke is fed to the pressure-type gasifier via said parallel-connected lock chambers, and wherein the coke is gasified in the pressure-type gasifier in a second gasification chamber thereon with the addition of at least one of oxygen and air, and at least one of steam and carbon dioxide.

2. The method according to claim 1, further comprising withdrawing a gas from said first gasification chamber and pre-purifying the gas, and wherein the compression gas for the locks is the prepurified gas.

3. The method according to claim 2, wherein the expansion gas from the locks is fed to the gas from the first cooling gasification chamber.

4. The method according to claim 1 or 2 or 3 comprising the step of compressing excess gas from the first cooling and gasification chamber and feeding the excess gas after compression to a pressure purification station for the gas from the pressure-type gasifier.

5. The method according to claim 2 comprising the step of adjusting the hydrogen to carbon monoxide ratio of the generated gas by adding coking gas from the coking chamber.

* * * * *